US006302375B1

(12) United States Patent
Heil et al.

(10) Patent No.: US 6,302,375 B1
(45) Date of Patent: Oct. 16, 2001

(54) DEMOLITION-LEVERAGE TOOL

(76) Inventors: Eric George Heil, 8479 Thomas Ave. N., Brooklyn Park, MN (US) 55444; George Burrill Heil, R.R. 1 Box 181, Theilman, MN (US) 55978

( * ) Notice: Subject to any disclaimer, the term of this patent is extended or adjusted under 35 U.S.C. 154(b) by 0 days.

(21) Appl. No.: 09/620,193

(22) Filed: Jul. 20, 2000

(51) Int. Cl.[7] ..... B66F 3/00
(52) U.S. Cl. ..... 254/17; 254/131
(58) Field of Search ..... 254/17, 131, 25, 254/28, 131.5; 29/252

(56) References Cited

U.S. PATENT DOCUMENTS

D. 199,019 * 8/1964 Marson ..... 254/25
1,570,192 * 1/1926 Younick ..... 254/25
2,502,271 * 3/1950 Parker ..... 254/25
2,520,427 * 8/1950 Nelson ..... 254/17
3,049,337 * 8/1962 Griggs ..... 254/25
5,325,576 * 7/1994 Henderson ..... 29/252

* cited by examiner

*Primary Examiner*—Joseph J. Hail, III
*Assistant Examiner*—Lee Wilson

(57) ABSTRACT

A demolition-leverage tool including a straight tube or pipe handle connecting at the base of the tube or pipe to a prying member attached at a right angle to the handle, a pivot bar attached at the base of the pipe handle where it intersects with the prying bar, disposed crosswise thereof, is a pivot bar being in operative juxtaposition to the prying member to serve as an off-center pivot point in relation to the prying member and when a force is applied to the handle portion of the tool, the demolition-leverage tool also has a detachable pad that connects to the pivot point of the tool, therefore allowing the tool not to sink into soft earth while the prying bar in underneath an object and sufficient force is applied to the handle as to raise the item underneath the prying bar.

7 Claims, 2 Drawing Sheets

DEMOLITION-LEVERAGE TOOL

CROSS REFERENCE TO RELATED APPLICATIONS (Not applicable)

STATEMENT REGUARDING FEDERALLY SPONSORED RESEARCH (Not applicable)

REFERENCE TO A MICROFICHE APPEXDIX (Not applicable)

BACKGROUND OF INVENTION

This invention relates to a single lever prying apparatus, specifically to prying apart lumber and lifting objects from the earth, and prying large sheets of drywall from walls.

Field of search 254/31.5,133r,132,120,121,113,018,019, 131

BACKGROUND DESCRIPTION

What the invention accomplishes:

Contractors and builders of many trades need various tools to accomplish tasks involved in building. My said invention combines a pry bar, leverage bar and pick into one tool.

The demolition-leverage tool is used for multiple construction tasks. Prying apart lumber which is nailed or screwed together is the main function. It can also be swung like a pick to penetrate walls and pry off drywall or the like. A base pad can be attached by a single bolt on the base of the tool. This allows the tool to be used as a leverage bar and the base pad keeps the tool from sinking into soft soil.

The demolition tool in U.S. Pat. No. 4,183,503 has the limited use of prying only, and due to the smaller size, requires a larger amount of human energy to pry the boards apart. My said invention has a long enough handle to pry larger material apart with minimum effort.

It is common for older homes to have lumber that is very difficult to pry apart. Conventional pry bars are of insufficient size to pry apart larger boards. Conventional pry bars quickly tire the operator out because of the added strength needed to pry apart the boards. The demolition-leverage tool holds multiple advantages over conventional pry bars. One major benefit of my demolition-leverage bar is the operator can pry up floor boards while standing up. This saves the operator from having to crawl on their hands and knees to work. This saves time, energy and medical troubles for operators.

In the customary use of a conventional prying or lifting bar, the tip of the bar is forced underneath the object that needs to be lifted. The operator then must find blocks of wood, etc. to use as a fulcrum point in order to gain leverage on the item to be lifted. By adding the optional base plate on the demolition-leverage tool of present invention, it can be utilized as a leverage bar capable of lifting heavy objects such as concrete, large rocks, pavement and the like. The chisel-like prying member is forced into the earth under the item the operator wants to lift. The operator then positions their body opposite the item to be lifted, not standing on top of the item to be lifted. The operator then pulls on the handle similar to the aforementioned operation of prying, causing the chisel-like prying member to rise up causing the item to lift.

Conventional tools such as picks, shovels and the like normally have a wooden handle which often breaks. The demolition-leverage tool is built of such solid construction it is extremely difficult to break the handle.

In the customary use of conventional wrecking-bars, the chisel-like end of one of the two prying members thereof must be forced between the floor joist or wall-stud, on the one hand, and the floor board or wall board on the other hand. This is done by repeatedly ramming or hammering the prying member of the wrecking-bar between the joist or stud and the board or roofer nailed thereto, until the prying member has sufficiently penetrated therebetween to enable the operator to pry the board or roofer from the joist or stud as in U.S. Pat. No. 5,695,172. Such repeated ramming action needed for each successive floor-board, roofer or sheathing board not only consumes more time and requires the expenditure of more energy than is necessary, than by using the demolition-leverage tool of the present invention, but also damages the board so removed as well as the joist or stud to which it is nailed, so as to impair their subsequent re-use or salvage value in cases where it is desired to re-use the dismantled boards and joist and studs.

Because the demolition-leverage tool lifts under the entire board at one time, and the fulcrum point rests on the stud or stringer, the operator can apply steady pressure to pry the boards apart, therefore causing minimal damage to the board. Also, due to the large fulcrum point, extremely long pole barn shank nails can easily be removed without having to place blocks of wood behind the tool, as is needed when prying with a hammer or prybar with too short of fulcrum point as seen in U.S. Pat. Nos. 4,844,416, 4,183,503 and 5,695,172.

In using the demolition-leverage tool of present invention substances commonly known as sheet-rock, drywall or plywood can also be removed. The operator swings the demolition-leverage tool similar to an ax or hammer swing, causing the chisel-like tip penetrate the wall. The operator then uses the wall-stud as a leverage point for the pivot bar. This operation saves time by breaking the drywall into larger pieces, which take less time to clean up.

OBJECTS AND ADVANTAGES

Accordingly, besides the objects and advantages of the demolition-leverage tool described in my above patent, several objects and advantages of the present invention are:

(a) An operator can pry flooring boards while standing up, saving unnecessary back strain.

(b) An operator can penetrate walls, and pry siding off without switching tools, therefore saving time.

(c) An operator can pry up large sheets of plywood at one time, due to the large fulcrum point not found in other patents.

(d) An operator can place said tool under a stud wall, door, or window and quickly lift into the needed position for shimming without the operator having to bend over (e) Fire departments and rescue crews can quickly break hinges off doors to gain access to buildings.

BRIEF SUMMARY OF THE INVENTION

The object of the present invention is a versatile one-piece demolition-leverage tool of simple, inexpensive and effective construction for prying floor-boards from floor-joists to which they are nailed and for prying wall-boards or wall-sheathing strips from wall-studs to which they are attached. This invention can also be plunged through a wall to remove drywall or sheetrock.

This invention has an attachment that independently connects to the base of the bar, which assists the operator in lifting heavy objects such as concrete, pavement and rocks. The base pad helps keep the tool from sinking into soft ground. A further object of the present invention is to facilitate and to reduce the labor and time required for such demolition operations, and to minimize the damage to the pried-apart pieces, thereby to preserve their utility for re-use.

Accordingly, the demolition-leverage tool of the present invention comprises of a straight steel tube handle bar with a shorter straight prying member affixed by welding to the steel tube at a right angle. The prying member has a pointed chisel-like tip at the end, opposite the base, for punching through walls, or to get underneath of the earth to lift concrete or the like. At the base of the tool where the prying member is connected to the tube handle is a crosswise-disposed pivot bar. This pivot bar serves as a pivot point for the prying member when force is applied to the handle bar.

A steel pad can be attached by a single bolt to the base of the tool. This base helps keep the tools from sinking into soft soil.

REFERENCE NUMERALS IN DRAWINGS

Figures 1, 2:
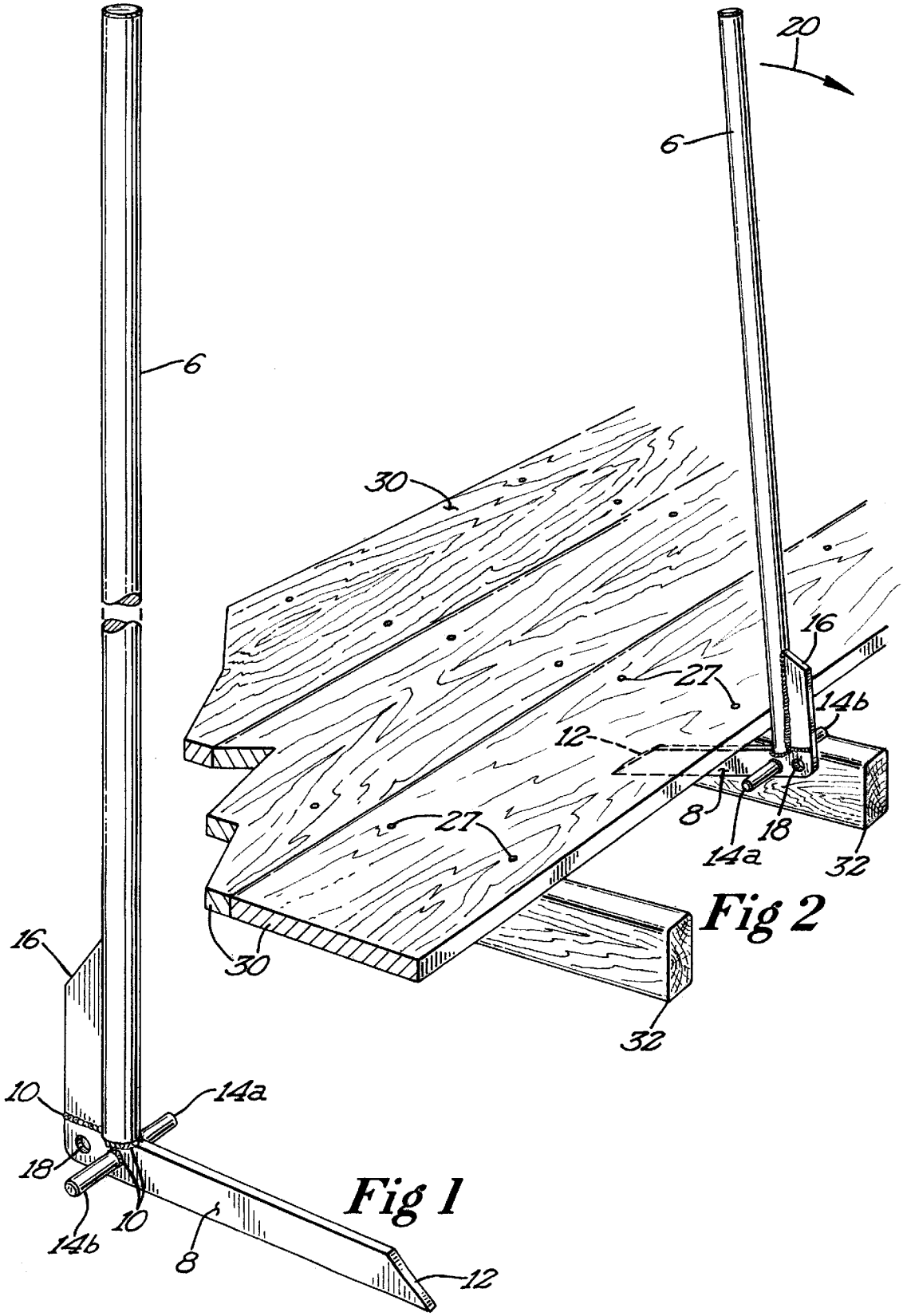
FIG. 1 shows a side view of the demolition-leverage tool.
FIG. 2 shows a side view of the demolition-leverage tool with the prying member underneath a piece of lumber to be pried up.

6) handle
8) prying member
10) weld
12) chisel-like tip
14*a*) pivot point
14*b*) pivot point
16) strength plate
18) hole
20) arrow
22) base of tool
24) base pad
26*a*) flat steel piece
26*b*) flat steel piece
26*c*) hole
27) nail
28) pin
30) floorboard
32) joist or stud
34) joist or stud
36) drywall
38) item to be lifted
40) earth/ground

DETAILED DESCRIPTION OF THE INVENTION

The demolition-leverage tool of the present invention, shown in FIG. 1 comprises of a steel tube or pipe handle 6 with a shorter prying member 8 welded to the base of handle 6 whereas making a ninety degree or right angle connection to said handle 6. Prying member 8 and handle 6 are connected by weld 10. Prying member 8 has a chisel-like tip 12 on the end opposite strength plate 16. Said demolition-leverage tool has a pivot point 14*a* and 14*b* welded to the base of said prying member 8. Pivot point 14*a* and 14*b* extends outward from prying member 8 at an approximate right angle. Strength plate 16 is connected to rear base of said handle 6 and prying member 8 adding sufficient strength as to keep said weld point 10 from breaking. Strength plate 16 displaces stress encountered while using the said demolition-leverage tool as to keep prying member 8 and handle 6 from breaking apart. Hole 18 is drilled at the rear base of prying member 8. Hole 18 is of sufficient size as to hold pin 28 for connecting base pad 24 in FIG. 4.

FIG. 2 illustrates the use of the demolition-leverage tool of the present invention in which prying member 8 engages the floor board, plank or sheathing 30, nailed 27 to the floor joist or roof joist 32, which are pried and so removed from the joist by pulling handle 6 in the direction of arrow 20 with two hands of the operator firmly closed on handle 6, with pivot point 14*a* against joist 32.

Figure 3:
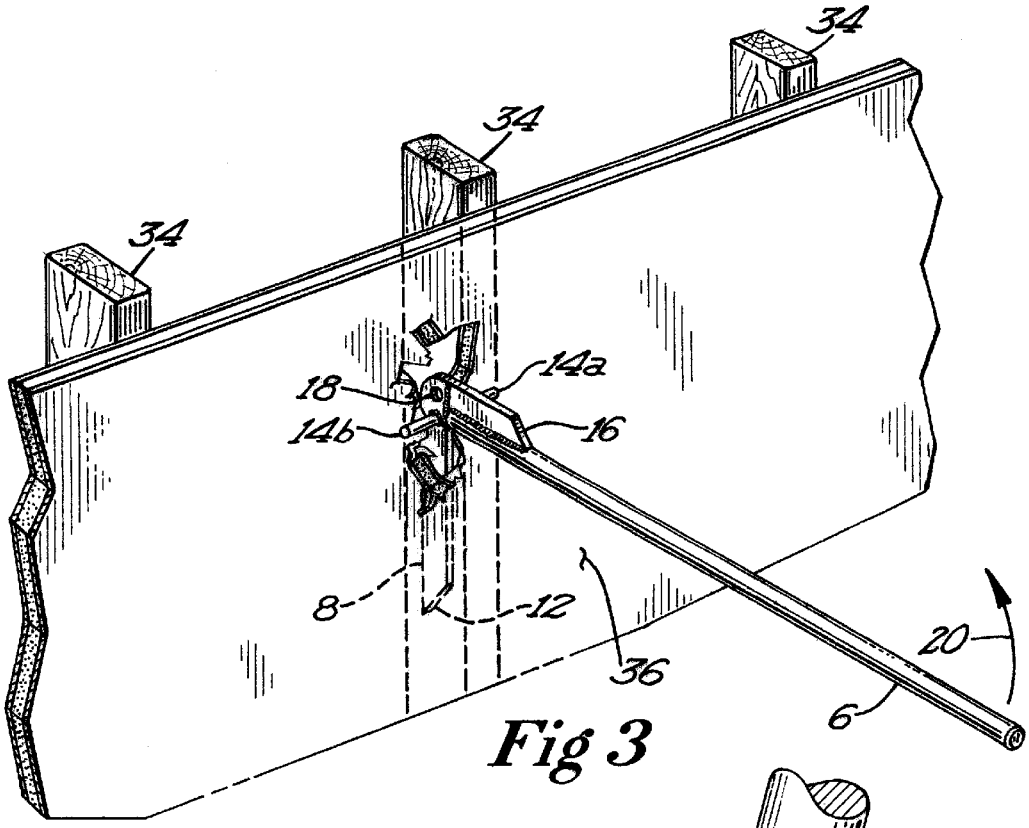
FIG. 3 shows the demolition-leverage penetrating a stud wall covered with drywall or sheet rock.

FIG. 3 illustrates a view of said demolition-leverage tool and studs 34 covered with drywall 36. An alternative use of the demolition-leverage tool of the present invention, in which the chisel-like tip 12 is plunged through drywall 36 by swinging the tool like an ax or hammer. The tool is then operated in the same manner as listed in FIG. 2, which are pried and so removed from the joists by pulling handle 6 of the demolition-leverage tool in the direction of arrow 20 with the two hands of the operator firmly closed on the handle-portion of handle 6, and pivot point 14*b* against stud 34, which causes prying member 8 to break the drywall loose from stud 34.

Figure 4:
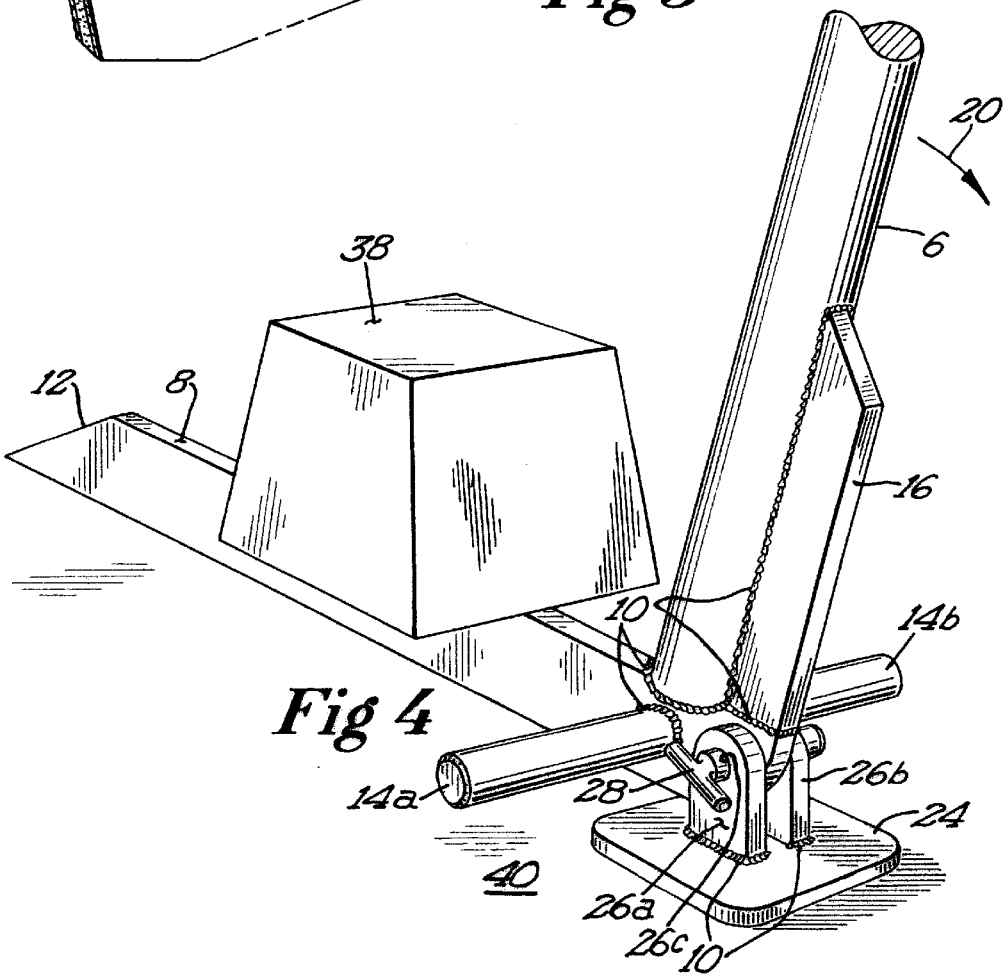
FIG. 4 shows a side view of the demolition-leverage tool, with the base plate attached, showing a piece of concrete being lifted.

FIG. 4 illustrates an alternative use of the demolition-leverage tool of the present invention, which base plate attachment 24 is added to the demolition-leverage tool by pin 28. Base plate attachment 24 is constructed of a flat piece of steel with two pieces of flat steel, 26*a* and 26*b* , welded 8 near the center of base plate 24. Said steel pieces 26*a* and 26*b* are spaced a sufficient distance apart as to allow prying member 8 clearance to fit between 26*a* and 26*b* thereby sandwiching prying member 8 between. Said pieces 26*a* and 26*b* have hole 26*c*, drilled near the end opposite base plate 24, of sufficient size as to fit pin 28 through. Pin 28 is placed through said hole 26*a*, then through hole 18 in prying member 8, then through 26*b* thereby attaching base plate 24 to prying member 8.

The operator swings said demolition-leverage tool similar to swinging an ax, pick, or hammer by handle 6 causing prying member 8 to gain access underneath item to be lifted 38. The operator then moves their body to the opposite side of the demolition-leverage tool, therefore not to stand on the object the operator wants to lift up 38. The operator pulls on handle 6 with two hands in the direction of arrow 20 therefore causing base pad 24 to sit on the ground 40 and prying member 8 to raise up lifting said item 38.

What we claim as our invention is:

1. A device for prying apart two pieces of lumber which are fastened together, comprising:

(a) an upper portion containing a longitudinal reference axis;

(b) a bottom prying member connected a plate and to said upper portion in an outwardly transverse direction by a predetermined distance; and (c) a lower portion connected to said bottom prying member.

2. The device according to claim 1 further comprising said lower portion in cooperative juxtaposition to said bottom prying member, said lower portion being fixedly disposed below and perpendicular to a longitudinal axis of said upper portion, wherein said lower portion comprising two opposite portions extending from said bottom prying member in opposite directions so as to serve as a pivot point about the longitudinal axis of the upper portion when said prying member is in its prying position.

3. The device according to claim 1 further comprising an end of said prying member have an angle of approximately 30 degrees machined on the tip, therefore giving the end of said piece a chisel-shaped.

4. The device according to claim 1 wherein said plate is a flat piece of metal, with an attachment point to said bottom prying member.

5. The device according to claim 4 further comprising of said plate is sandwiched between said bottom prying member.

6. The device according to claim 5 further comprising said plate be attached by a bolt or pin.

7. The device according to claim 1 comprising said upper portion which is of a sufficient length so as to accommodate a human being.

* * * * *